US007250022B2

(12) United States Patent
Dalebout et al.

(10) Patent No.: US 7,250,022 B2
(45) Date of Patent: Jul. 31, 2007

(54) EXERCISE DEVICE WITH CENTRALLY MOUNTED RESISTANCE ROD

(76) Inventors: William T. Dalebout, 1980 N. Watertree La., North Logan, UT (US) 84321; Michael Olson, 783 N. 100 West #4, Logan, UT (US) 84321

( * ) Notice: Subject to any disclaimer, the term of this patent is extended or adjusted under 35 U.S.C. 154(b) by 547 days.

(21) Appl. No.: 10/173,515

(22) Filed: Jun. 14, 2002

(65) Prior Publication Data

US 2003/0232707 A1 Dec. 18, 2003

(51) Int. Cl.
*A63B 21/00* (2006.01)

(52) U.S. Cl. ..... 482/142; 482/140; 482/121; 482/130

(58) Field of Classification Search ..... 482/129, 482/130, 142, 103, 121, 138, 148, 137, 126, 482/101, 127, 131, 96, 95, 111; 124/25.6, 124/900

See application file for complete search history.

(56) References Cited

U.S. PATENT DOCUMENTS

| | | | | |
|---|---|---|---|---|
| 9,695 A | | 5/1853 | Hinsdale | |
| 192,338 A | | 6/1877 | Marshall | |
| 325,435 A | * | 9/1885 | North | 186/22 |
| 428,912 A | | 5/1890 | Holmes | |
| 484,352 A | | 10/1892 | Ayton | |
| 588,350 A | | 8/1897 | Perkins | |
| 610,716 A | | 9/1898 | Marshall | |
| 685,788 A | | 11/1901 | McFadden | |
| 754,992 A | | 3/1904 | Grabner | |
| 807,670 A | | 12/1905 | Grabner | |
| 852,193 A | | 4/1907 | McMillan | 607/78 |
| 964,745 A | | 7/1910 | Blakoe | |
| 1,019,861 A | | 3/1912 | Titus | |
| 1,115,826 A | | 11/1914 | Johnson | |
| 1,123,272 A | | 1/1915 | Goodman | |
| 1,144,085 A | | 6/1915 | Abplanalp | |
| 1,495,278 A | | 5/1924 | Titus | |
| 1,576,474 A | | 3/1926 | Walker | |
| 1,585,748 A | | 5/1926 | Wendelken | |
| 1,698,831 A | | 1/1929 | Titus | |
| 2,346,105 A | | 4/1944 | Haehnel | 66/127 |
| 2,456,017 A | | 12/1948 | Park | 272/79 |
| 2,763,156 A | | 9/1956 | Garigal | 73/381 |
| D182,660 S | | 4/1958 | Hastings | D34/5 |

(Continued)

FOREIGN PATENT DOCUMENTS

DE 23 46 105 3/1975

(Continued)

OTHER PUBLICATIONS

Advertisement for Canadiana, *Big 16I,* Body-Building publication, Feb. 1962 (1 page).

(Continued)

*Primary Examiner*—Jerome Donnelly

(57) ABSTRACT

An exercise machine has resilient elongate members for providing balanced resistance in the form of elongate resilient members oriented horizontally such that the intermediate portion of the elongate members contact a fulcrum of the exercise machine. The user adjusts the amount of resistance provided by capturing different combinations and numbers of resilient elongate members. A cable and pulley system ensures a long stroke so that the use can perform a wide variety of exercises in comfortable positions.

50 Claims, 11 Drawing Sheets

U.S. PATENT DOCUMENTS

| | | | | | |
|---|---|---|---|---|---|
| 2,855,200 | A | | 10/1958 | Blickman | |
| 2,968,337 | A | | 1/1961 | Bartlett | 155/18 |
| 3,000,628 | A | * | 9/1961 | Kellogg | 29/235 |
| 3,342,485 | A | | 9/1967 | Gaul | |
| 3,465,592 | A | | 9/1969 | Perrine | 73/379 |
| 3,567,219 | A | | 3/1971 | Foster | |
| 3,601,398 | A | | 8/1971 | Brochman | 273/26 E |
| 3,638,941 | A | | 2/1972 | Kulkens | 272/83 R |
| 3,640,528 | A | | 2/1972 | Proctor | 272/81 |
| 3,658,327 | A | | 4/1972 | Thiede | |
| 3,664,916 | A | | 5/1972 | Grellier et al. | |
| 3,690,655 | A | | 9/1972 | Chapman | 272/81 |
| 3,708,167 | A | | 1/1973 | Potgieter | |
| 3,797,624 | A | | 3/1974 | Powell et al. | |
| 3,858,874 | A | | 1/1975 | Weider | 272/79 R |
| 3,884,464 | A | | 5/1975 | Evangelos | 272/79 R |
| 3,892,404 | A | | 7/1975 | Martucci | 272/79 R |
| 3,918,710 | A | | 11/1975 | Niebojewski | 272/81 |
| 3,957,266 | A | | 5/1976 | Rice | 272/125 |
| 3,958,803 | A | | 5/1976 | Geisselbrecht | 272/135 |
| 3,981,500 | A | | 9/1976 | Ryan | |
| 4,026,548 | A | | 5/1977 | Birdwell | 272/136 |
| 4,063,727 | A | | 12/1977 | Hall | |
| 4,072,309 | A | | 2/1978 | Wilson | 272/136 |
| 4,074,409 | A | | 2/1978 | Smith | 29/446 |
| 4,076,237 | A | | 2/1978 | Dussia | 272/136 |
| 4,082,267 | A | | 4/1978 | Flavell | 272/125 |
| 4,131,701 | A | | 12/1978 | VanAuken | 428/36 |
| 4,157,181 | A | | 6/1979 | Cecka | 273/80 |
| 4,231,568 | A | | 11/1980 | Riley et al. | 272/136 |
| 4,307,880 | A | | 12/1981 | Abram | 272/146 |
| 4,316,609 | A | | 2/1982 | Silberman | 272/118 |
| 4,316,610 | A | | 2/1982 | Hinds | 272/137 |
| 4,328,965 | A | | 5/1982 | Hatfield | 272/137 |
| 4,334,678 | A | | 6/1982 | Doyel | 272/141 |
| 4,355,061 | A | | 10/1982 | Zeigler | 428/36 |
| 4,384,715 | A | | 5/1983 | Savio et al. | 272/136 |
| 4,428,577 | A | | 1/1984 | Weingardt | 272/135 |
| 4,441,708 | A | | 4/1984 | Brentham | 272/130 |
| 4,465,276 | A | | 8/1984 | Cox | 272/137 |
| 4,494,662 | A | | 1/1985 | Clymer | |
| 4,521,013 | A | | 6/1985 | Dofel | 272/136 |
| 4,603,855 | A | | 8/1986 | Sebelle | 272/117 |
| 4,620,704 | A | | 11/1986 | Shifferaw | |
| 4,685,670 | A | | 8/1987 | Zinkin | 272/136 |
| 4,721,303 | A | | 1/1988 | Fitzpatrick | 272/117 |
| 4,725,057 | A | * | 2/1988 | Shifferaw | 482/130 |
| 4,756,527 | A | | 7/1988 | Ledbetter | |
| 4,790,596 | A | | 12/1988 | Shifferaw | |
| 4,898,381 | A | | 2/1990 | Gordon | 272/117 |
| 5,005,832 | A | * | 4/1991 | Van Der Hoeven | 482/124 |
| 5,022,377 | A | | 6/1991 | Stevens | 124/23.1 |
| 5,039,088 | A | | 8/1991 | Shifferaw | |
| 5,123,886 | A | | 6/1992 | Cook | |
| 5,151,071 | A | | 9/1992 | Jain | 482/101 |
| 5,211,617 | A | | 5/1993 | Millen | 482/127 |
| 5,421,801 | A | | 6/1995 | Davies, III et al. | 482/131 |
| 5,529,560 | A | | 6/1996 | Davies, III et al. | 482/131 |
| 5,626,547 | A | | 5/1997 | Davies, III et al. | 482/131 |
| 5,895,342 | A | | 4/1999 | Solland | 482/96 |
| 5,967,950 | A | * | 10/1999 | Hsu | 482/96 |
| 6,003,294 | A | | 12/1999 | Fitzgerald et al. | |
| 6,011,134 | A | | 1/2000 | Marks et al. | |
| 6,082,346 | A | * | 7/2000 | Andrews et al. | 124/25.6 |
| 6,113,522 | A | | 9/2000 | Fontenot et al. | 482/111 |
| 6,172,178 | B1 | | 1/2001 | Koning et al. | |
| 6,217,495 | B1 | | 4/2001 | Yalch | |
| 6,238,322 | B1 | | 5/2001 | Hsu | |
| 6,238,323 | B1 | | 5/2001 | Simonson | |
| 6,319,179 | B1 | | 11/2001 | Hinds | |
| 6,335,100 | B1 | | 1/2002 | Tominaga et al. | |
| 6,585,626 | B2 | | 7/2003 | McBride | 482/130 |
| 6,595,905 | B2 | * | 7/2003 | McBride | 482/130 |
| 6,685,607 | B1 | * | 2/2004 | Olson | 482/142 |

FOREIGN PATENT DOCUMENTS

| | | |
|---|---|---|
| DE | 32 31 228 | 2/1984 |
| GB | 5867 | 0/1913 |
| GB | 134847 | 1/1920 |
| GB | 325435 | 2/1930 |
| GB | 374240 | 6/1932 |
| GB | 496740 | 2/1937 |
| GB | 466901 | 6/1937 |
| GB | 841537 | 7/1960 |
| GB | 1 326 704 | 8/1973 |
| JP | 365694 | 6/1950 |
| JP | 55-148571 | 11/1980 |

OTHER PUBLICATIONS

MegaFitness.com, *Band Flex Home Gym,* printed Aug. 14, 2002, Copyright 1997-2002, 5 pgs.
LeonardFitness.com, *Bandflex Home Gym,* printed Aug. 14, 2002, Copyright 1999-2001, 4 pgs.
LeonardFitness.com, *Bowflex® Power Pro,* printied Aug. 20, 2002, Copyright 1999-2001, 3 pgs.
Website, www.bowflex.com, printed Sep. 17, 2002, 96 pgs.
Bowflex® Power Pro®, *Owner's Manual & Fitness Guide,* Copyright 2001, 80 pgs.
Bowflex® Power Pro®, *Assembly Manual,* Copyright 2000, 28 pgs.
*Lat Pulldown Attachment Assembly Instructions,* available, on information and belief, at least as early as Mar. 2002, 10 pgs.
Reviewboard.com, *Bowflex Power Pro XTLU,* printed Aug. 20, 2002, 2 pgs.
NickPicks.com, *As Seen on TV Bowflex,* printed Aug. 20, 2002, 3 pgs.
2002 Project Abstract (including "University of Wyoming Zero Gravity Construction"), printed Aug. 20, 2002, 9 pgs.
Bowflex Trainer, *Power Rod Resistance,* printed Aug. 20, 2002, 1 pg.
Battle for the Best Pecs, printed Aug. 20, 2002, 3 pgs.
Soloflex.com, *Soloflex®, Compound Barbell,* printed Sep. 17, 2002, 1 pg.
Bowflex.com, *Get Results with a Blowlfex Home Gym,* printed Sep. 17, 2002, Copyright 2002, 2 pgs.
Breithard Muscle Builder Apparatus, *Breithard Pupils Say it with Muscles!,* May 4, 1929 (3 pages).
Marcy Gymnasium Equipment Co., *Physical Fitness Equipment for the Entire Family* (1 page).
Weider Barbell Co., *Giant Multiplex Builder* (1 page).
Canadiana, *Big 16* (1 page).
Broom Hall, *Broom's Advanced International Course* (1 page).
Verlag Athletik, *Universal Twister* (1 page).
RetroSearch, nerac.com, printed Jul. 2, 2004 (4 pages).
Advertisement for Breitbart Muscle Building Apparatus, *Breitbart Pupils Say it with Muscles!,* May 4, 1929 (3 pages).
Advertisement for Marcy Gymnasium Equipment Co., Physica Power publication, Apr. 1964 (1 page).
Advertisement for Weider's *Giant Multiplex Builder,* Muscle Power publication, Jan. 1949 (1 page).
Advertisement for *Broom's Advanced International Course,* SUPERMAN publication, Dec. 1938 (1 page).
Advertisement for *Universal Twister* in Athletik Sport Journal (Holland), 1972 (1 page).
Inventor disclosure by Tessema Shifferaw relating to Ex-Stick I, available on information and belief at least as early as Sep. 1982 (5 pages).
Inventor disclosure by Tessema Shifferaw relating to Ex-Stick 2, available on information and belief at unknown date later than Sep. 1982 (1 page).

* cited by examiner

EXERCISE DEVICE WITH CENTRALLY MOUNTED RESISTANCE ROD

BACKGROUND OF THE INVENTION

1. The Field of the Invention

The present invention relates to exercise devices. More specifically, the present invention relates to an exercise device having resilient elongate members for providing resistance against which a user can exercise.

2. Background and Relevant Art

Society in general is becoming more health-conscious. A result of this has been an increased demand for fitness devices that can be utilized to attain and maintain healthy levels of fitness. Multi-function exercise machines have been developed in response to this demand. Multi-function exercise machines are often adapted to be convenient to operate and store, while still providing the range of exercises necessary to provide effective all around fitness.

One type of conventional multi-function exercise machine utilizes a stack of weights to provide resistance needed by users during exercise. A user repetitively raises some, or all, of the weight stack. The force of gravity provides the resistance needed to allow the user to exercise. However, due to the mass of the weights, these machines are heavy and can be difficult for a home user to move.

Exercise machines that use flexible members to provide resistance have been developed as an alternative to weight stack machines. One such device available in the market incorporates two sets of flexible rods of varying resistance. The bottom end of each set of rods is attached to the base of the machine with the rods extending vertically upwards therefrom. A cable is attached to the top end of each set of rods by means of a large hook that is threaded through loops at the top end of each rod. By bundling the rods in this manner, the user can adjust the amount of resistance used during exercise. By displacing the cables, a user can utilize the resistance provided by the flexible rods to exercise various muscle groups.

However, the manner in which the hook apparatus must be used to bundle the flexible rods together is awkward, requiring the use of two hands, i.e. a first hand to hold the hook and a second hand to thread the hook through the loops on the rods. Since there are two sets of rods, this process must be done twice.

In addition, since there are two sets of rods, there are two independent sources of resistance, adding a level of complexity to the use of the exercise apparatus. For example, the user must carefully monitor the amount of resistance used on each side in order to maintain equilateral workout resistances for each side of the body. Moreover, the length of the user's stroke is limited to the how far the ends of the flexible rods can be displaced, whereas certain exercises require a long stroke.

There is, therefore, a need for an improved exercise device that utilizes flexible members to provide resistance. There is a need for an exercise device having readily adjustable resistance that is simple and efficient. There is also a need for a device that has an efficient stroke length.

BRIEF SUMMARY AND OBJECTS OF THE INVENTION

The exercise machine of the present invention has a support assembly to which are coupled a plurality of resilient elongate members, a cable and pulley system, and, optionally, a bench. The exercise machine is adapted to allow a user to exercise using the resistance provided by the flexible, resilient, elongate members. The configuration of the exercise machine provides many benefits including, for example: exercise rods positioned on a fulcrum at the intermediate portion of the rods, a capture device enabling one handed addition and removal of resistance rods, movement of both ends of the resilient elongate members when the cable is drawn, equivalent resistance on both ends of the cable independently of whether equal amounts of resistance are provided at the cable ends, a cable and pulley system providing compounding effects of the resistance, rotatable resilient elongate members allowing convenient storage of the device, and a plurality of additional features and benefits.

A resilient elongate member assembly comprises a plurality of elongate members positioned on a fulcrum. In a preferred embodiment, horizontally oriented resilient elongate members of the present invention are centrally positioned on the fulcrum. The resilient elongate members flex when a force is applied to them, and are used to provide resistance for the user to exercise against. The user is able to adjust the amount of resistance used during exercise by using a pair of capture devices to add or delete resilient elongate members utilized to provide resistance. These are coupled to each end of a resilient elongate member and are adapted to allow the user to selectively capture resilient elongate members to increase or decrease the resistance. In a preferred embodiment, the capture device is adapted to allow the user to add or delete resilient elongate members using one hand.

The cable and pulley system comprises a plurality of pulleys and one or more cables. The cable and pulley system is configured such that a pulley is coupled to each end of a resilient elongate member assembly. A cable is adapted to be threaded through these pulleys. Additional pulleys are used to alter the direction of the cable to accommodate traditional exercise positions. Handles and other exercise accessories are adapted to be selectively coupled to the cable and pulley system to allow a user to utilize the resistance provided by the resilient elongate members. The resilient elongate members flex downwards following the path of the cable to provide resistance. Further pulleys are cables can be coupled to the machine to enable a wide variety of exercise to be undertaken.

The cable and pulley system of the present invention allows the user to take a long stroke due to the mechanical advantage provided by the cable and pulley system. The cable and pulley system also eliminates the need to capture the same amount of resistance at each end of the resilient elongate member assembly.

The user can benefit from a bench as source of balance and stability when doing exercises. A leg exercise unit is attached to the bench. The leg exercise unit can be connected to the cable and pulley system, thus allowing the user to undertake a variety of leg exercises against the resistance of the resilient elongate members.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
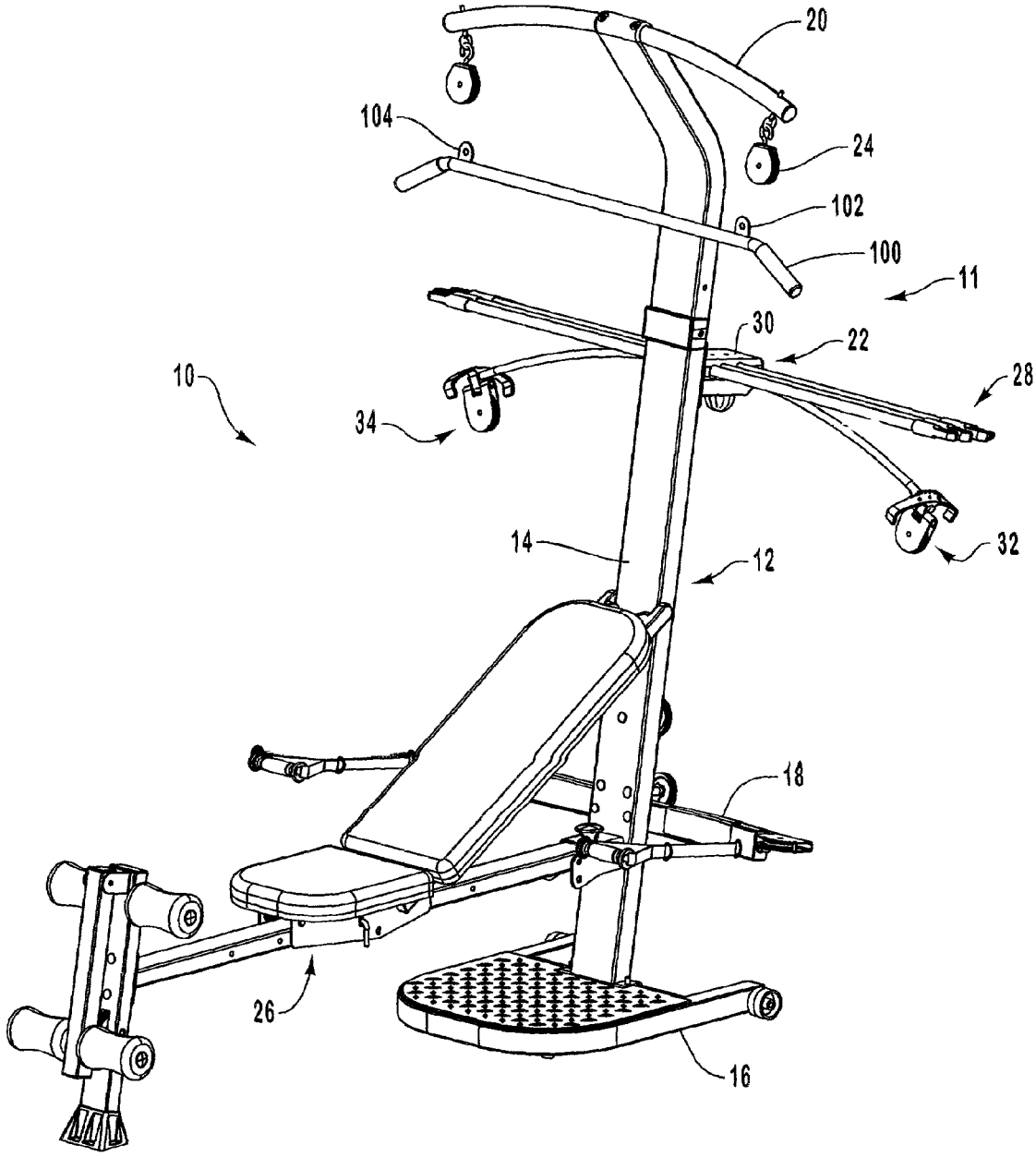
FIG. 1 illustrates a perspective front view of an exercise machine according to one embodiment of the present invention.

An exercise machine 10 of the present invention is shown in FIG. 1. Exercise machine 10 of FIG. 1 includes a support assembly 11 comprising (i) a frame 12 and (ii) a fulcrum 30. Support assembly 11 provides a mechanism for integrating components of the exercise machine 10, the components including, for example, a plurality of resilient elongate members 28, a cable and pulley system 24 (cables not shown in FIG. 1), and, optionally, a bench 26.

Frame 12 comprises a post 14, a base member 16 which contacts a support surface (e.g., a floor or the ground), a lower horizontal member 18 and an upper horizontal member 20. Post 14 provides a rigid upright for connecting various components of the present invention. Base member 16 is coupled to the bottom end of post 14 and may include wheels thereon for convenient moving of device 10. Base member 16 provides a bottom support for post 14.

Lower horizontal member 18 is coupled to post 14. Upper horizontal member 20 is coupled to the upper portion of post 14. Frame 12 can include a variety of components combined in a variety of configurations without departing from the scope and spirit of the present invention. For example, frame 12 can be configured such that one or more of the referenced components is not present. For instance, upper horizontal member 20, which facilitates overhead exercises, is not provided on a machine designed only for low reach exercises.

In an alternative embodiment of the present invention, the frame comprises another vertical surface such as a wall or pole. Thus, a cable and pulley system (e.g., system 24) and a fulcrum (e.g., fulcrum 30) may be coupled to such a surface (e.g., a pole or wall), in which case the surface forms a frame for the device. A frame of substantially horizontal orientation can also be used.

A resilient elongate member assembly 22 of the present invention comprises: (i) a plurality of resilient elongate members 28; (ii) a fulcrum 30; and (iii) capture devices 32, 34. The plurality of resilient elongate members 28 of the present invention are positioned on fulcrum 30.

In another embodiment, a resilient elongate member assembly of the present invention comprises a plurality of resilient elongate members coupled integrally to a fulcrum, which is coupled to the frame. In yet another embodiment, a single resilient elongate member is employed.

A cable and pulley system 24 is also coupled to frame 12. The cable(s) of the system 24 are shown, for example, in FIGS. 2 and 7. Cable and pulley system 24 provides a mechanism for utilizing the resistance provided by the plurality of resilient elongate members 28. In one embodiment, the cable and pulley system 24 is selectively coupled to frame 12 and at least one of the plurality of resilient elongate members 28.

Figure 2:
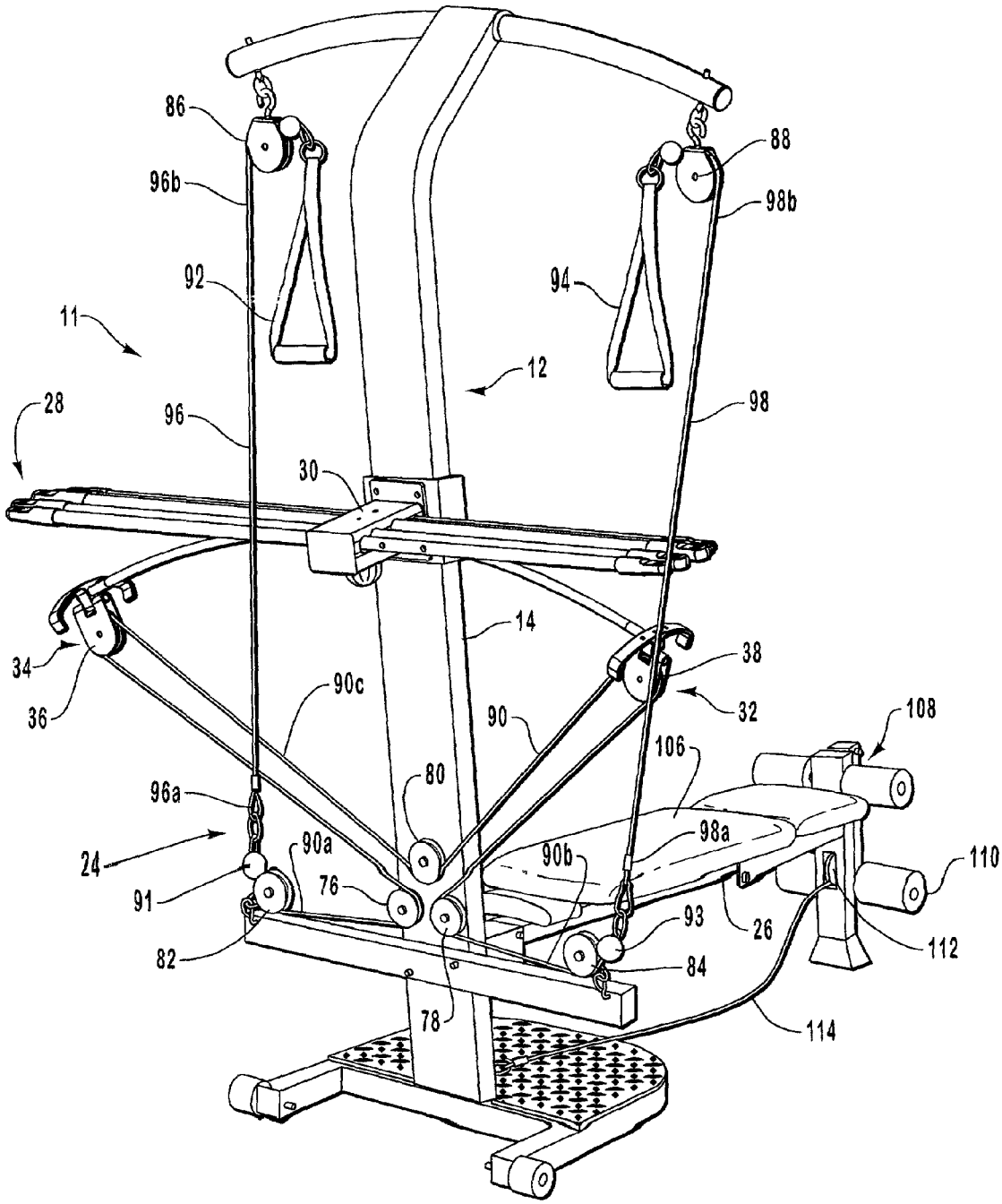
FIG. 2 is a perspective view of the back of the exercise machine of FIG. 1 featuring cables of the cable and pulley system and having alternative pulley brackets mounted onto a lower, horizontal member of the frame.

With reference now to FIG. 2, there is shown the cable and pulley system 24 of exercise machine 10 as well as additional components of exercise machine 10. The exercise machine 10 includes a bench 26 coupled to upstanding member 14 of frame 12. Bench 26 has an adjustable seat 106 and a leg exercise unit 108. When performing certain exercises on the machine, the user sits on adjustable seat 106 to provide the necessary support and balance. Leg lever 110 of leg exercise unit 108 may be attached to cable and pulley system 24 by cable 114. Cable 114 is fixed at a first end to leg lever 110, is threaded over pulley 112, and can be selectively coupled at its second end to first end 90*a* or second end 90*b* of cable 90. In an alternative embodiment, the second end of cable 114 splits into or couples to dual cables, each dual cable end being coupleable to a corresponding end 90*a* or 90*b* of cable 90. When cable 114 is coupled to cable 90, force exerted on leg lever 110 is transmitted through cable 114 and cable 90, causing the captured resilient elongate members to flex.

A variety of components and configurations of exercise device 10 can be utilized without departing from the scope or spirit of the present invention. For example, in alternative embodiments, a bench unit is not included as part of the exercise machine, or other components not previously discussed are utilized.

The cable and pulley system 24 comprises pulleys 36, 38, 76, 78, 80, 82, 84, 86, and 88 and cables 90, 96, 98, and 114. Optionally, a single cable may be substituted for cables 90, 96, and 98. Pulleys 76, 78, and 80 are coupled to upstanding member 14. Pulleys 82, 84 are coupled to lower horizontal member 18. Pulleys 86, 88 are coupled to upper horizontal member 20. Pulleys 36, 38 are coupled to resilient elongate members 28.

Cable 90 is coupled to pulleys 76, 78, 80, 82, 84, 36, 38. Cable 90 comprises a first end 90*a*, a second end 90*b*, and an intermediate portion 90*c*. The intermediate portion 90*c* is the portion of cable 90 threaded through pulleys 76, 78, 80, 82, 84, 36, and 38. Handles 92, 94 are shown coupled to cables 96, 98, (e.g., for lat pull down exercises) but may optionally be coupled directly to opposing ends 90*a*, 90*b* of cable 90 for a variety of other exercises if desired.

First end 90*a* and second end 90*b* of cable 90 allow users to exert a force on resilient elongate members 28. When a user displaces first end 90*a* and/or second end 90*b*, interaction between intermediate portion 90*c* and pulleys 36 and 38 displaces pulleys 36 and 38.

In one embodiment, the coupling of pulleys 36 and 38 to the ends of the one or more of the plurality of resilient elongate members 28, and the associated configuration of cable 90, is such that movement of the first end 90*a* or second end 90*b* of cable 90 causes movement of both ends of one or more of the plurality of resilient elongate members. For example, in the embodiment of FIG. 2, movement of the first end 90*a* or second end 90*b* of cable 90 causes movement of both ends of the resilient elongate member shown as being flexed in FIG. 2.

Figure 6:
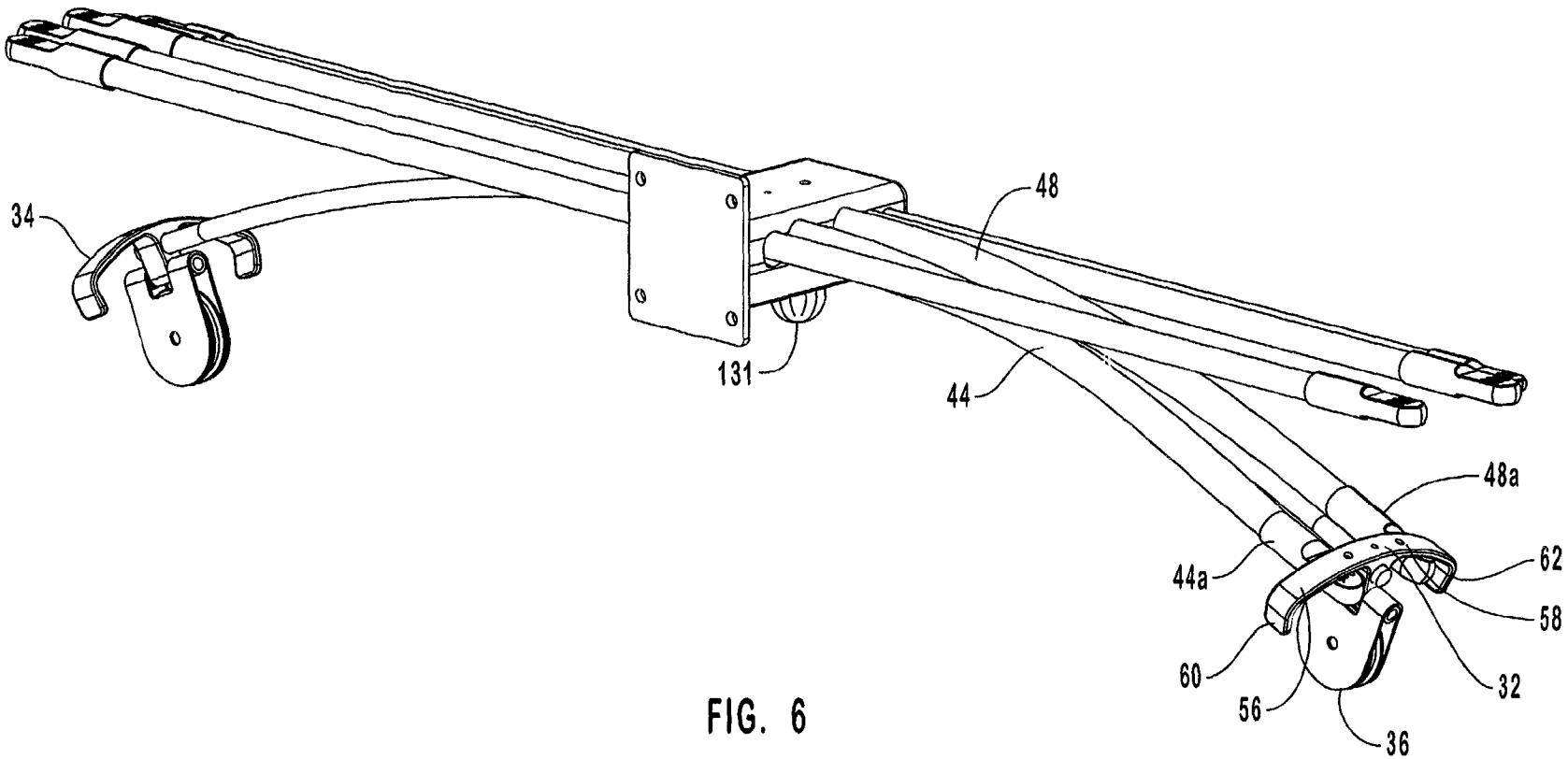
FIG. 6 illustrates a resilient elongate member assembly of an exercise machine of the present invention showing the ends of multiple resilient elongate members held by one of the capture devices of the assembly.

One or both ends of another resilient elongate member can be captured by one or more respective capture devices 32 shown in FIG. 2 in order to increase resistance (see FIG. 6). In other words, either one end or both ends of a resilient elongate member may be captured in order to increase resistance.

Pulleys 82 and 84 of FIG. 2 may be coupled to the lower horizontal member of frame 14 through a variety of different methods, such as through the use of (i) an eyebolt coupled to the frame and (ii) a u-shaped bracket or eyebolt coupled thereto, which is in turn coupled to the respective pulley bracket. In another embodiment, such as shown in FIG. 1 and in FIG. 8, the pulleys are coupled to the frame through the use of a pulley bracket coupled to a first tube (or pin), which pivots within a second tube coupled to the frame.

Ballstops 91, 93 coupled to respective ends 90*a*, 90*b* prevent cable 90 from slipping off the pulleys of cable and pulley system 24. Ballstops 91, 93 also enable a degree of tension in cable and pulley system 24.

As previously mentioned, to exercise using the machine, force is exerted on cable 90. Cable 90 is adapted to be moved by the user against the resistance of the resilient elongate members.

The first end 90*a* of cable 90 can be selectively coupled to detachable handle 92 or cable 96. The second end 90*b* of cable 90 can be selectively coupled to detachable handle 94 or cable 98. This selective coupling allows the user to attach detachable handle 92 to first end 90*a* and attach detachable handle 94 to second end 90*b* and then move detachable handles 92, 94 in a direction away from pulleys 82, 84. The user can then carry out a variety of low reach exercises.

Thus, the user can assemble the cable and pulley system and exercise on the device by attaching first end 96*a* of cable 96 to first end 90*a* of cable 90; attaching first end 98*a* of cable 98 to second end 90*b* of cable 90; coupling cable 96 to pulley 86; coupling cable 98 to pulley 88; attaching detachable handle 92 to second end 96*b* of cable 96; attaching detachable handle 94 to second end 98*b* of cable 98; and moving detachable handles 92, 94 in a direction away from pulleys 86, 88. Optionally, handles 92, 94 may be attached directly to cable 90. Additionally, instead of detachable handles 92, 94, the user may attach an overhead bar 100 (FIG. 1) to cable 90 or to cables 96, 98 at second ends 96*b*, 98*b* using eyelets 102, 104 respectively. A variety of other mechanisms may also be employed.

Figure 3A:
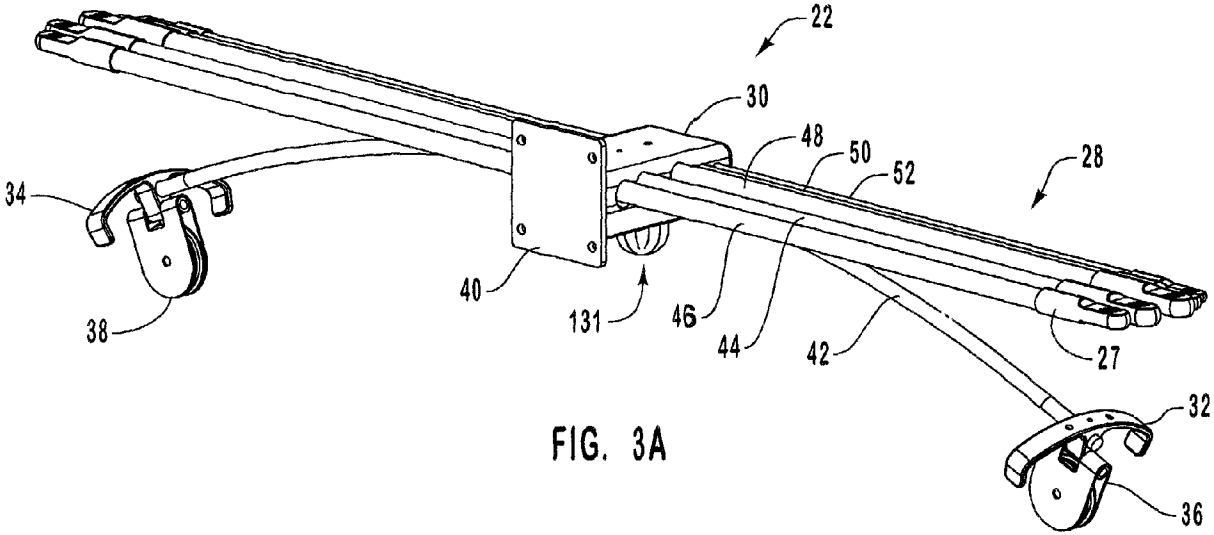
FIG. 3A illustrates a perspective view of a resilient elongate member assembly of the exercise machine the present invention.
Figure 3B:
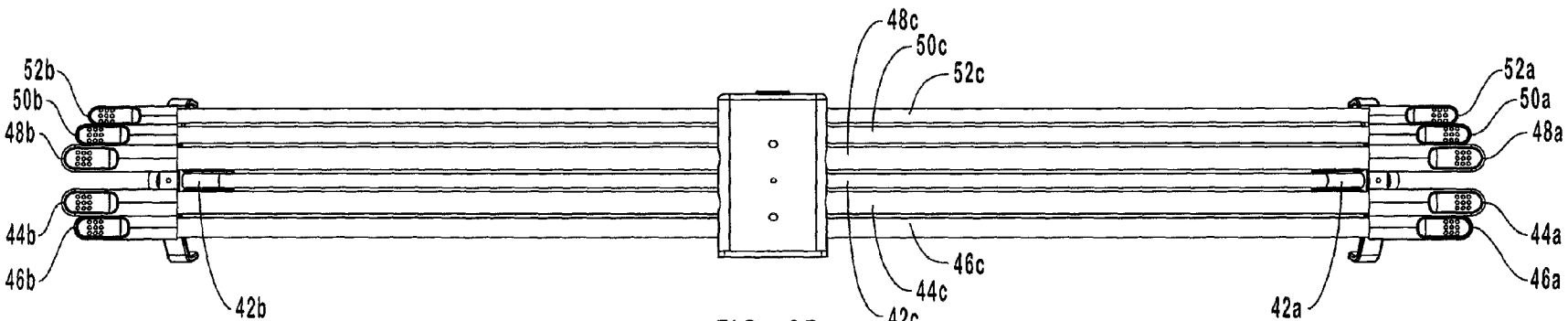
FIG. 3B illustrates a top view of the resilient elongate member assembly of FIG. 3A.

With reference now to FIGS. 3A and 3B, there is shown resilient elongate member assembly 22, which comprises fulcrum 30 and resilient elongate members 28 and capture devices 34.

In one preferred embodiment, there are six flexible, resilient elongate members 42, 44, 46, 48, 50, 52, although fewer or more flexible, resilient elongate members can be used. They are positioned to contact fulcrum 30 of support assembly 11 at their intermediate portions 42*c*, 44*c*, 46*c*, 48*c*, 50*c*, 52*c*. By having intermediate portions 42*c*, 44*c*, 46*c*, 48*c*, 50*c*, 52*c* positioned in contact with support assembly 11, downward movement of the ends of the resilient elongate members is resisted. The resilient elongate members are flexibly coupled to fulcrum 30.

As will be appreciated by those skilled in the art, a variety of configurations of the resilient elongate member assembly can be utilized without departing from the scope and spirit of the present invention. For example, a plurality of separate flexible resilient elongate members can be utilized.

Alternatively, the resilient elongate member assembly comprises a single elongate member comprising an intermediate portion and a plurality of flexible resilient elongate fingers extending from opposing ends of the intermediate portion. In one such embodiment, the intermediate portion is integral with the fingers. For example, the resilient elongate member assembly may be molded as a single integral piece. The intermediate portion, for example, may be directly or indirectly coupled to a frame.

With continued reference to FIG. 3A, in one embodiment, fulcrum 30 is coupled to post 14 of frame 12 in part through the use of baseplate 14. In an alternative embodiment, fulcrum 30 or another fulcrum of the present invention is integrally coupled to the frame. Thus, the fulcrum of the present invention may be integrally or non-integrally coupled to the frame. The fulcrum may be immovably coupled to the frame or movably coupled to the frame.

In one embodiment, fulcrum 30 is movably coupled to frame 14. By being movably coupled, fulcrum 30 allows the plurality of resilient elongate members 28 to be rotatable between a first position (e.g., substantially horizontal) for use and a second position (e.g., substantially vertical) for storage.

In the embodiment illustrated in FIGS. 3A and 8-10, fulcrum 30 is movably coupled to upstanding member 14. A locking assembly such as locking pin assembly 131 allows a user to selectively lock fulcrum 30 in a first position for use or in a second position for storage. In another embodiment, the fulcrum is immovably affixed (e.g., integrally or non-integrally) to the frame.

Resilient elongate members 42, 44, 46, 48, 50, 52 provide resistance against which the user can exercise. Each flexible, resilient elongate member 42, 44, 46, 48, 50, 52 has a first end 42*a*, 44*a*, 46*a*, 48*a*, 50*a*, 52*a* and a second end 42*b*, 44*b*, 46*b*, 48*b*, 50*b*, 52*b* that extend away from respective intermediate portions thereof. Each resilient elongate member is comprised of a resilient material. In a preferred embodiment, the resilient elongate member is comprised of nylon, although other materials are possible, such as wood laminates, steel leaf springs, fiberglass and/or acetal.

The elongate members may further comprise a coating on the nylon material or other material employed, such as a protective coating, e.g., a polyolefin material, or a variety of other coatings which may provide a protective layer and/or an aesthetically pleasing appearance. However, such coatings are not required. In one embodiment, the elongate members comprise a gripping/wear-resistance material 27 (FIG. 3A) at the tips thereof, which may comprise an ABS plastic material, for example. A number or other indicia can be provided on the gripping/wear-resistance material 27 to identify the amount of resistance that is provided by each elongate member.

In a preferred embodiment, the resilient elongate members are adapted to provide a range of different amounts of resistance. In one embodiment, the amount of resistance provided by resilient elongate members 42, 44, 46, 48, 50, 52 corresponds with the diameter of the resilient elongate member. A variety of different diameters may be employed. For example, resilient elongate members 46, 44, 42, 48, 50, and 52 may have diameters of ⅞ inch, 1 inch, 11/16 inch, 1 inch, ¾ inch and ⅝ inch respectively, for example. 1⅛ inch members may be vertically stacked above such members, for example. However, in alternative embodiments other diameters can be used. Optionally, seven elongate members, or one, two, three, four, five, eight, nine, ten, or a vast number of possibilities of other members may be employed. In an alternative embodiment all the resilient elongate members have the same diameter. In yet another embodiment, different resistance amounts are provided irrespective of the diameter of the resilient elongate members, e.g., by employing different materials.

Resilient elongate member 42 is shown in a flexed position in FIG. 3A. Coupled to resilient elongate member 42 at first end 42*a* is a capture device 32, which is in turn coupled to pulley 36. Coupled to resilient elongate member 42 at second end 42*b* is capture device 34, which is in turn coupled to pulley 38. In alternative embodiments, fewer or more pulleys can be coupled to the capture devices. In yet another embodiment, one or more resilient elongate members are coupled directly to resilient elongate members 28.

Figure 4:
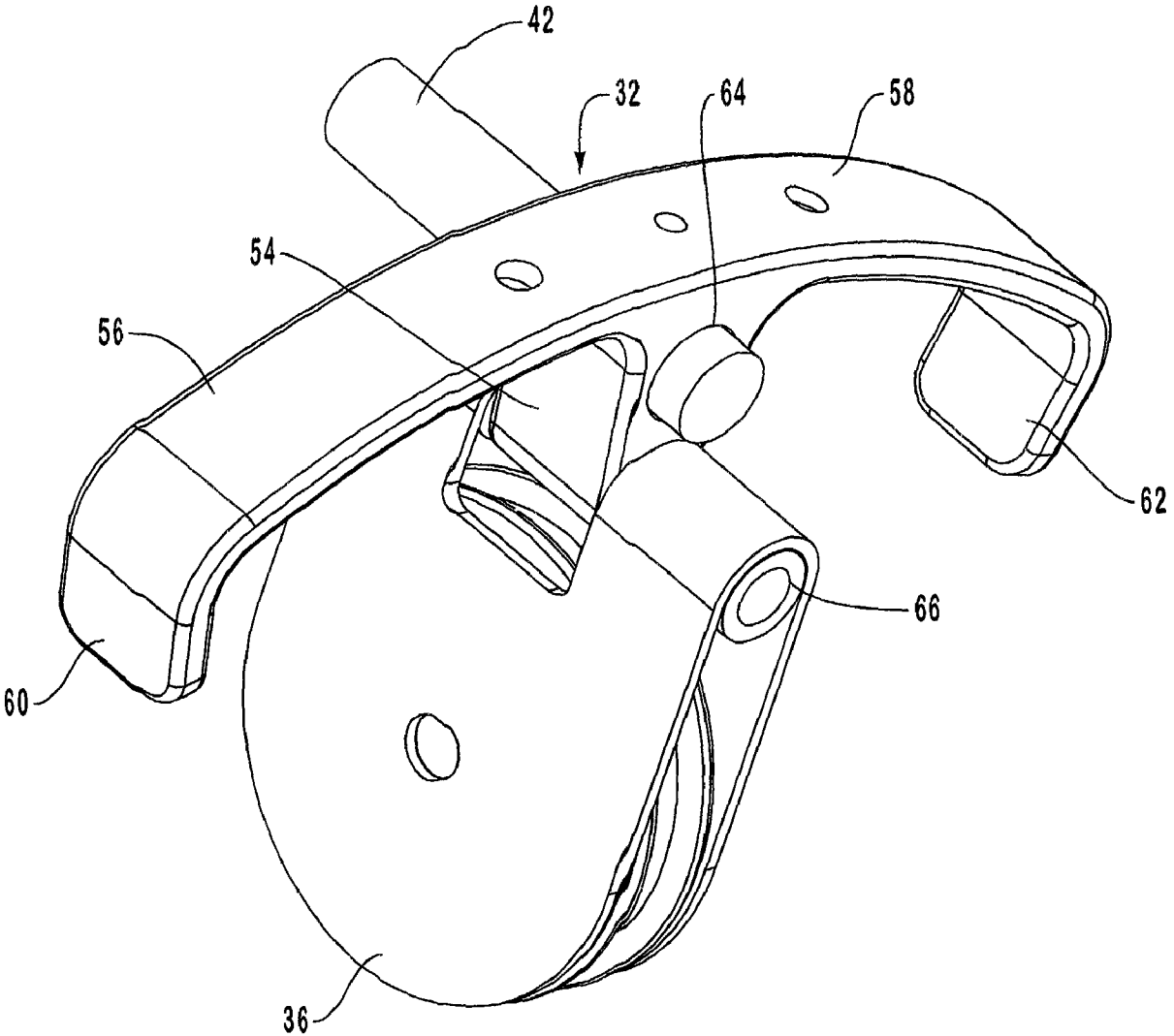
FIG. 4 illustrates a perspective view of a capture device that is configured to capture the ends of one or more resilient elongate members according to one embodiment of the present invention.
Figure 10:
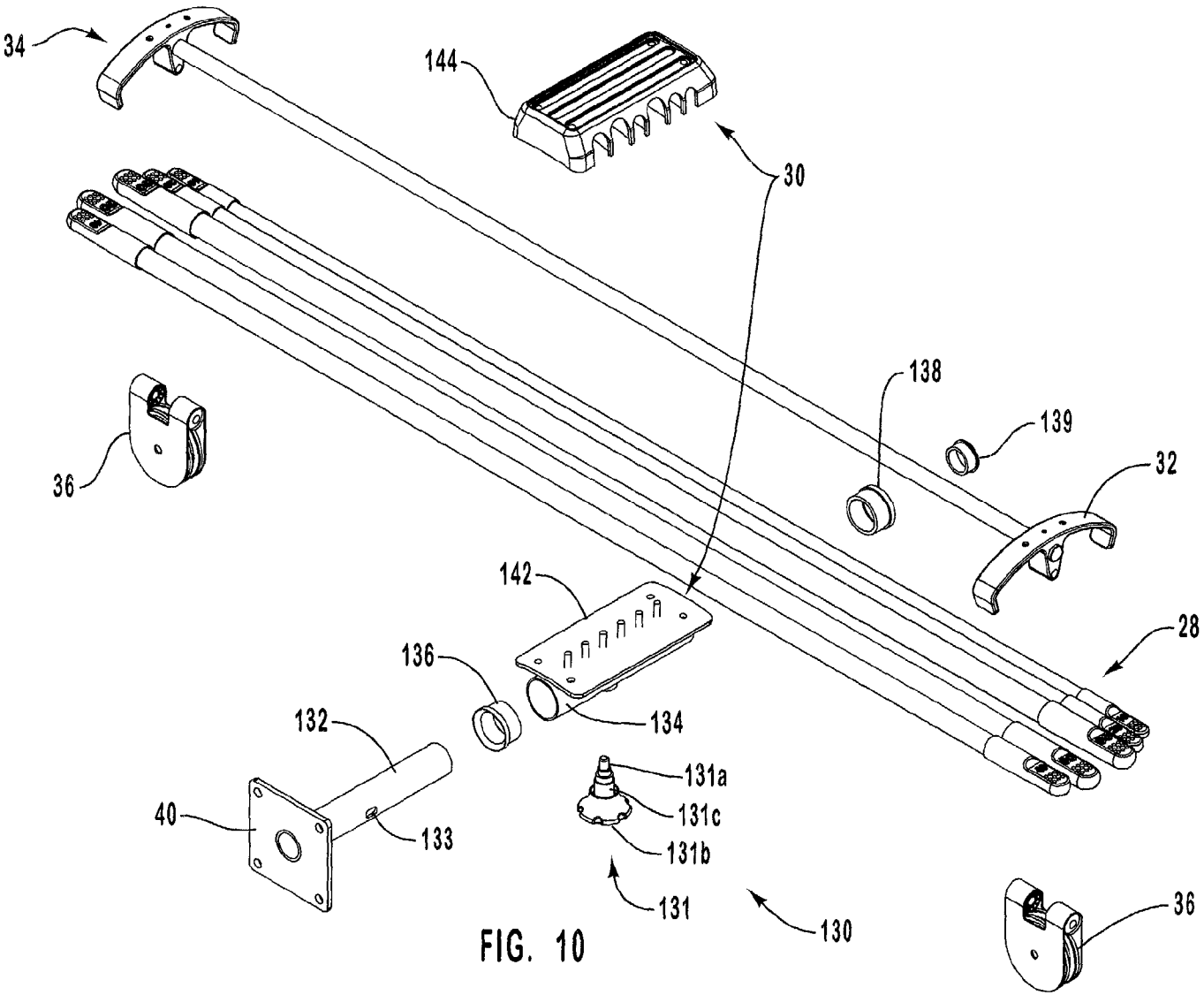
FIG. 10 is a view illustrating the resilient elongate member assembly of the present invention, including the rotatable fulcrum components according to one embodiment of the present invention.

With reference now to FIGS. 4 and 10, there is shown capture device 32 according to one embodiment of the present invention, which may be the same as or similar to capture device 34. Capture device 32 comprises a main body 54, a first capture member 56 coupled to the main body 54, a second capture member 58 coupled to the main body 54, and a first tab 60 and a second tab 62 extending from respective capture members. Capture members 56, 58 are substantially horizontal in orientation. The main body 54 is coupled lengthwise to resilient elongate member 42.

Extending outwards from main body 54 are first capture member 56 and second capture member 58. Extending downwards from first capture member 56 is first tab 62, and extending downwards from second capture member 58 is second tab 60. As will be appreciated by those skilled in the art, capture devices with fewer or more capture members and tabs are possible.

Main body 54 may be coupled to a resilient elongate member by means of an upper aperture 64, into which the resilient elongate member is inserted. Pulley 36 is coupled to the main body 54 of capture device 32 by means of a pin 66 extending through the pulley bracket and a lower aperture of main body 54. Pin 66 allows pulley 36 to pivot in its coupling with main body 54, while the machine is being used.

Figure 5A:
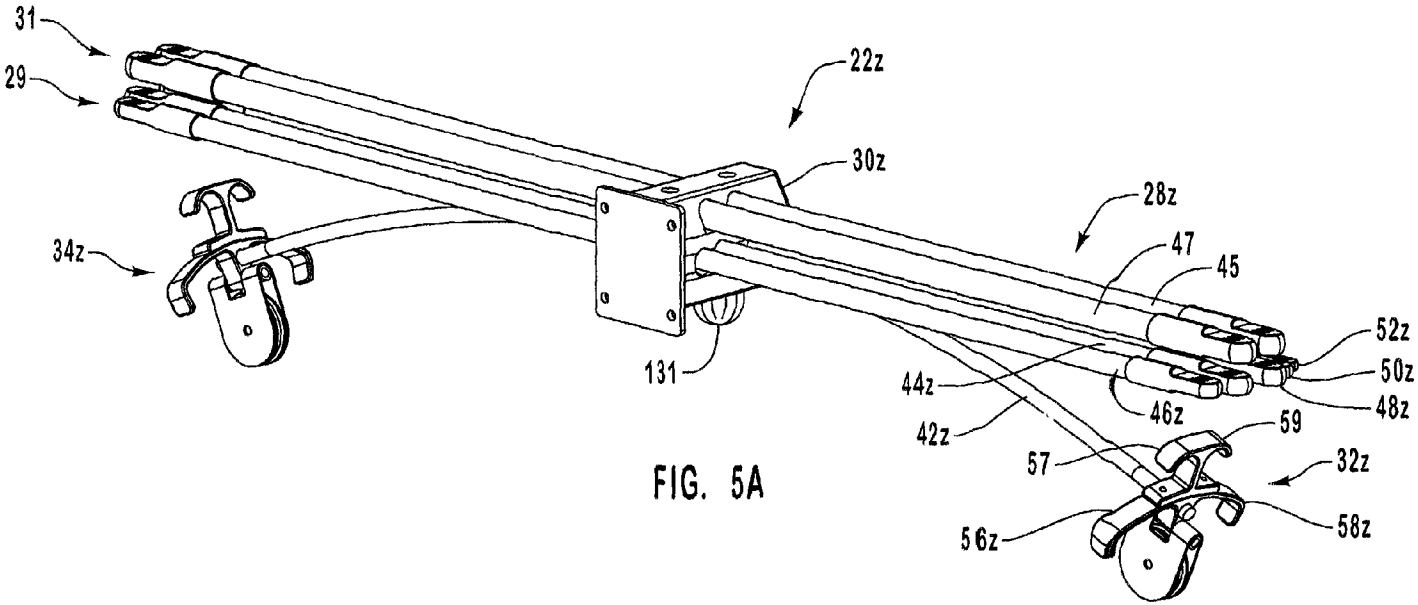
FIG. 5A illustrates a perspective view of an alternative embodiment of a resilient elongate member assembly of the present invention featuring vertically stacked elongate members.
Figure 5B:
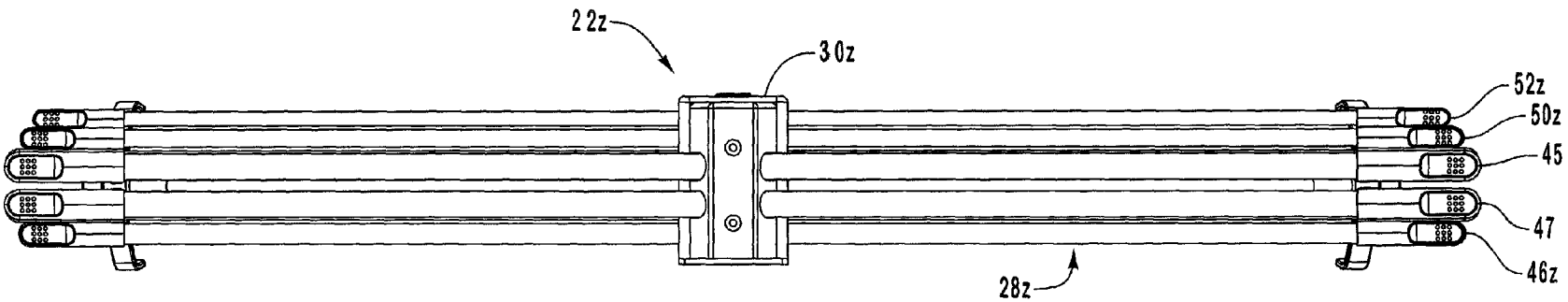
FIG. 5B illustrates a the assembly of FIG. 5A.

With reference now to FIGS. 5A and 5B, there is shown an alternative embodiment of a resilient elongate member assembly 22*z*. The resilient elongate assembly 22*z* comprises a fulcrum 30*z*, a plurality of resilient elongate members 28*z* and two capture devices 32*z*, 34*z*. In this embodiment, resilient elongate members 28*z* are arranged in two rows 29, 31. There are eight resilient elongate members 42*z*, 44*z*, 45, 46*z*, 47, 48*z*, 50*z*, 52*z*. In order to be able to capture row 31 of resilient elongate members 28*z*, capture device 32*z* has a pair of capture members 57, 59 mounted on top of capture members 56*z*, 58*z*. Capture device 34*z* is similarly configured. By having more resilient elongate members, the total amount of resistance that the user is able to select is increased.

Figure 5C:
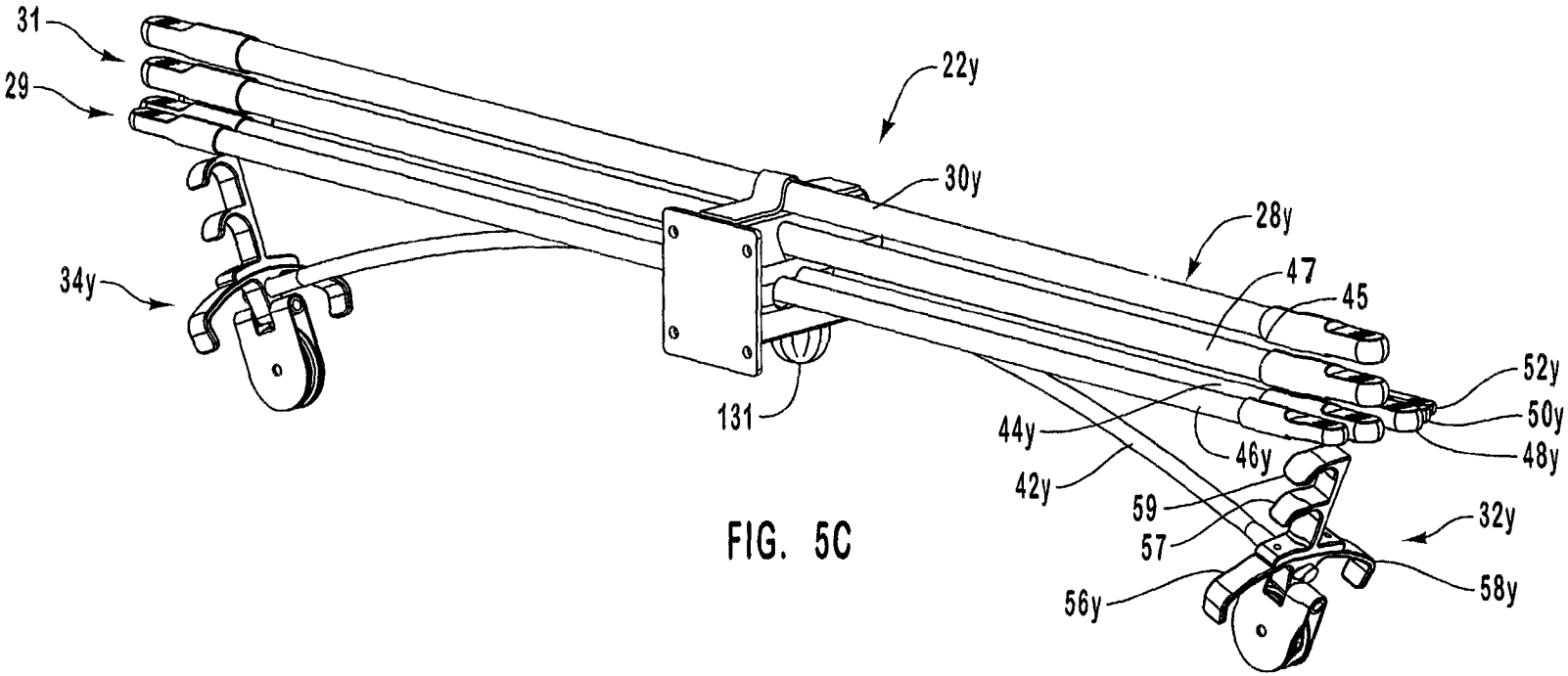
FIG. 5C illustrates a perspective view of another alternative embodiment of a vertically stacked resilient elongate member assembly.

With reference now to FIG. 5C there is shown yet another alternative embodiment of a resilient elongate member assembly 22*y*. In the embodiment, capture members 57, 59 are mounted on top of capture device 32*y* such that capture member 57 and capture member 59 form openings facing the same direction. The openings are configured to capture resilient elongate members 45 and 47. Capture members 57, 59 are mounted on top of capture members 56*y*, 58*y*. Capture device 34*y* is similarly configured. In the embodiment, resilient elongate members 45 and 47 are positioned such that resilient elongate member 45 is placed immediately above resilient elongate member 47.

With reference now to FIG. 6, there is shown how capture devices 32, 34 are used to capture resilient elongate members. It can be seen that resilient elongate members 44, 48 have been captured at their first ends 44*a*, 48*a* by capture device 32. The capturing of resilient elongate members 44, 48 is accomplished by capture members 56, 58. Thus, it can be seen that first end 44*a* of resilient elongate member 44 is captured underneath capture member 56 of capture device 32. The resilient elongate members are prevented from horizontal movement by respective tabs 60. 62.

Once captured, resilient elongate members 44, 48 are subject to the force applied at pulley 36 and flex as a result of the application of force. By selecting the number and configuration of resilient elongate members to capture, the user is able to select the amount of resistance with which to exercise. The more resilient elongate members that are captured, the higher the resistance provided. In one embodiment, the amount of resistance depends on the diameter of the resilient elongate members captured. In an alternative embodiment, resilient elongate members of different materials can be used in the resilient elongate member assembly, and resistance can depend on the material of the resilient elongate members captured.

Capture device 32 allows a user to select and retain at least one end of resilient elongate member 44. To capture the resilient elongate member 44, the user presses downwards on first end 44*a* and manipulates it around tab 62 or tab 60 to position an end 44 of the resilient elongate member 44 under a capture member 56 or 58. Once first end 44*a* is below capture device 32, the user releases first end 44*a*. By releasing first end 44*a*, the resilience of the resilient elongate member biases the first end 44*a* upward and under capture device 32 such that capture device 32 retains first end 44*a*. The user can then perform the same operation with the second end 44*b* of member 44 and capture device 34 if the user desires to capture both ends of resilient elongate member 44. However, only a single end may be captured if desired.

Unlike devices of the prior art, capture device 32 of the present invention is adapted to eliminate the need to thread the resilient elongate members 28 onto a hook-like device. Neither do the resilient elongate members 28 need to be configured to receive a hook-like device. The present invention merely requires that the user manipulate the end of the resilient elongate member under the capture device. In addition to simplifying adjustment of the resistance amount, the user can make such adjustments using only one hand. This allows the user to use both hands to capture two resilient elongate members at the one time, making the process of varying the resistance more efficient. Further, each hand can manipulate more than one resilient elongate member at once. In a preferred embodiment, the user can capture every resilient elongate member simultaneously using both hands. To release a resilient elongate member, the operation is performed in reverse. Again, the release of the resilient elongate members can be accomplished using only one hand.

In the embodiment of FIGS. 1, 3A, and 6, since resilient elongate member 42 is always affixed to the cable and pulley system, some resistance is always provided. From this starting point, any subsequent increase in resistance can be accomplished by capturing a resilient elongate member using one hand.

Once resilient elongate members 28 are captured, the resilient elongate members 28 can remain in a defined path as they flex. As a result, resilient elongate members 28 flex evenly.

Fulcrum 30 comprises an assembly that covers the top and bottom surfaces of an intermediate portion of elongate members. Thus, fulcrum 30 is configured such that one or both ends of a particular elongate member may be flexed. Fulcrum may be configured as a clamshell assembly (see, e.g., FIG. 10).

Figure 7:
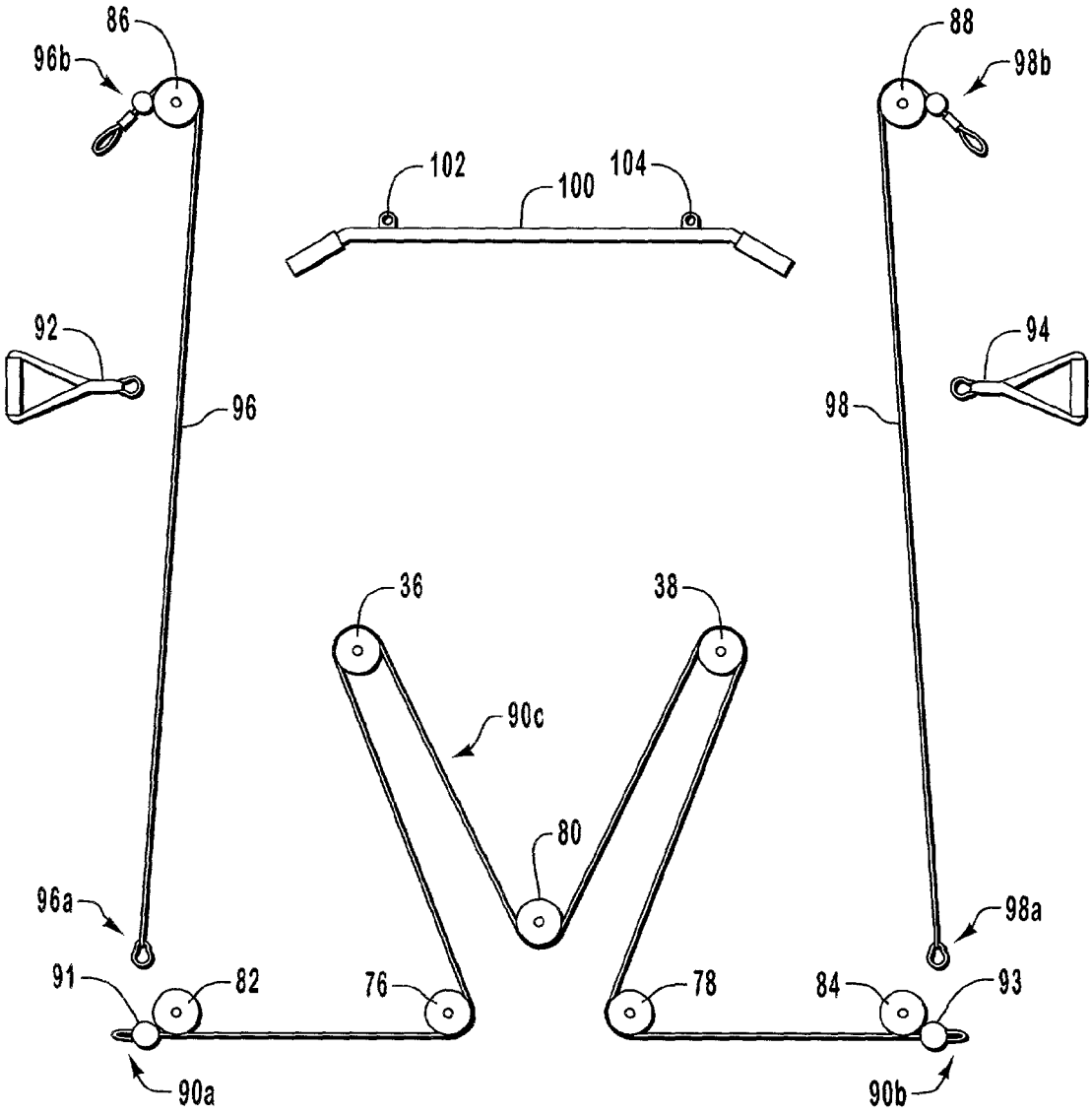
FIG. 7 is a schematic perspective view of one embodiment of the cable and pulley system of an exercise machine of the present invention.

With reference now to FIG. 7, there is shown the cable and pulley system as illustrated in FIG. 2 according to one embodiment of the present invention. The cable and pulley system is adapted to convey resistance provided by one or more resilient elongate members. In one embodiment, one or more cables of the cable and pulley system are adapted to be coupled to a first and second point of resistance provided by the resilient elongate members. In the illustrated embodiment, pulleys 36, 38 are essentially floating pulleys. By using floating pulleys, the total amount of displacement provided by the cable first and second ends is greater than the total amount of displacement provided by the first and second end of the resilient elongate member when the first end and second end of the resilient elongate member are flexed.

In the present embodiment, pulleys 36, 38 are coupled to the resilient elongate members 28 by means of capture devices 32, 34. Movement of the resilient elongate members in response to a force applied to cable 90 is approximately doubled at the first end 90*a* and second end 90*b* of cable 90. In other words, the amount of cable displaced as the user pulls both ends of the cable is approximately twice the amount of displacement of both ends of the resilient elongate members. This means that during an exercise routine the user has more cable to manipulate, so a longer stroke can be accomplished with a smaller relative displacement of the resilient elongate members. This allows the user to assume normal, traditional, and/or comfortable positions when using the machine. Pulleys 36, 38 represent one example of a first and second point of resistance.

When force is exerted on cable 90 at either one or both ends 90*a*, 90*b* of cable 90, both ends of captured resilient elongate members will move. Thus, a force can be exerted on cable 90 by a first and/or second grip member adapted to permit a user to utilize a resistance conveyed by the cable and pulley system. The amount of movement depends on the amount of resistance captured. In one embodiment, the resistive force of the first end of each resilient elongate member is equal to the resistive force of the second end of the resilient elongate member. However, unequal amounts of resistance captured on each side of the machine can result from having different configurations of flexible elongate members retained by the capture devices on each side of the exercise machine. The movement of each resilient elongate member is in inverse proportion to its resistive force. Thus, the end with captured resilient elongate members providing the least amount of total resistance will be drawn downwards the farthest distance.

Nevertheless, independent of the amount of resistance captured on each side, the resistance experienced at first end 90*a* of cable 90 will be the same as that experienced at second end 90*b*. This is achieved because of the configuration of the pulley and cable system of the present invention.

Thus, an equal amount of resistance will be provided to a first and second grip member 92, 94 even through an unequal amount of resistance is provided at the first and second points of resistance (e.g., pulleys 36, 38). If an equal amount of force is applied by the user to both ends 90*a*, 90*b* then the same amount of cable will be drawn at each end. This will occur despite any unevenness in the amount of movement of the first ends 42*a*, 44*a*, 46*a*, 48*a*, 50*a*, 52*a*, and second ends 42*b*, 44*b*, 46*b*, 48*b*, 50*b*, 52*b* of the resilient elongate members 42, 44, 46, 48, 50, 52.

This means that the user does not have to ensure that each capture device 32, 34 captures the same number and type of resilient elongate members. In short, the user need not obtain an equal amount of resistance on each capture member 32, 34 for each cable end 90*a*, 90*b* to obtain an equal proportion of encountered resistance during exercise. Thus, it is possible for the device to be used effectively with resilient elongate members captured only at one end, for example.

When force is exerted by a user at only one end of cable 90, the mechanical advantage provided by pulleys 36, 38 is approximately four fold. When force is exerted by a user at both ends of cable 90, the mechanical advantage experienced is approximately two fold. Essentially, for any given amount of captured resistance, it is easier to pull with one hand at one end of cable 90 than with one hand at each end of cable 90.

Thus, the total resistance experienced when force is simultaneously exerted at both ends of the cable is greater than the resistance experienced at the first end of the cable when force is exerted at the first end alone. In one embodiment, the total resistance experienced when force is simultaneously exerted at both ends of the cable is approximately twice the resistance experienced at the first end of the cable when force is exerted at the first end alone. In light of the unique configuration of this device, this resistance is experienced by the user along with the balanced feel of equal resistance in the opposing ends of the cable.

Figure 8:
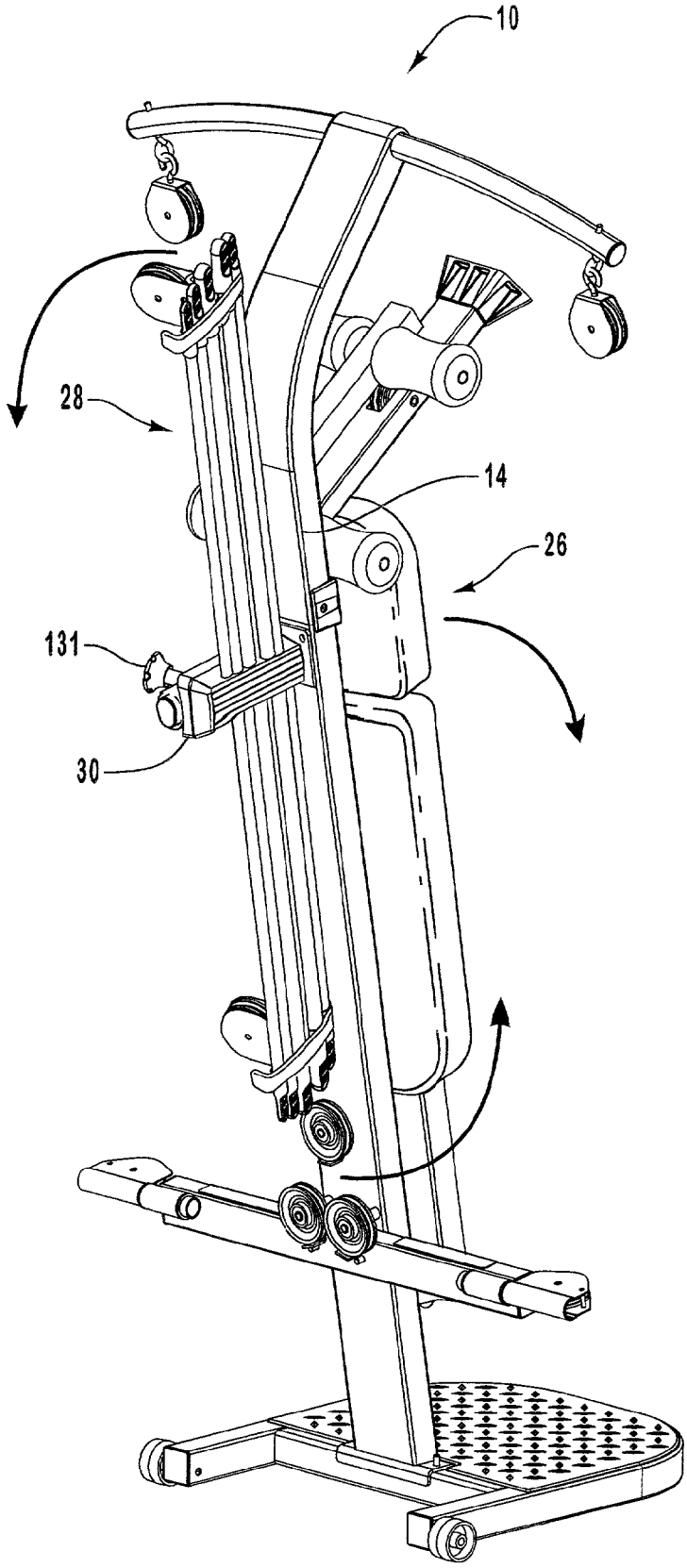
FIG. 8 is a perspective view illustrating the exercise machine of the present invention in which the resilient elongate members and bench are in a storage position (device shown without cables)
Figure 9:
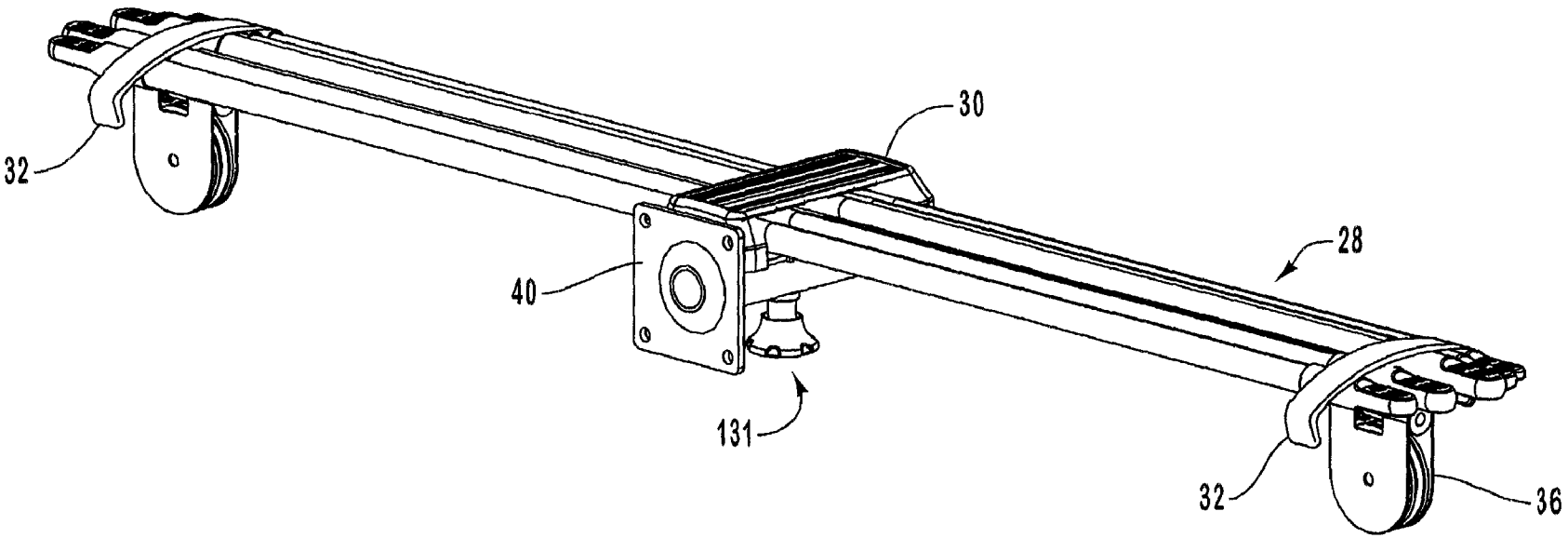
FIG. 9 illustrates a resilient elongate member assembly having a fulcrum which is rotatable, such that the resilient elongate member assembly is movable into a substantially horizontal use position or a substantially vertical storage position.

With reference now to FIGS. 8-10, there is shown an embodiment of the exercise machine 10 illustrating the manner in which the exercise machine 10 is adapted to be placed in a storage position or a use position. In the embodiment shown, bench 26 and the plurality of resilient elongate members 28 are foldable to allow exercise machine 10 to be placed in a storage position.

When exercise machine 10 is in the storage position (FIG. 8), bench 26 and the plurality of resilient elongate members 28 are positioned adjacent to, and substantially parallel with, the upper portion of post 14 in a substantially vertical orientation. In the use position, bench 28 is positioned substantially perpendicular to post 14 and is resting on the floor and the plurality of resilient elongate members 28 are positioned substantially perpendicular to post 14. For an example of bench 26 and the plurality of resilient elongate members 28 in a use position, see FIG. 1.

In the embodiment of FIGS. 8-10, frame 12 comprises a pin 132 on which fulcrum 30 is rotatably coupled, such that fulcrum 30 is rotatably coupled to frame 12. Pin 132 serves as an inner pin since it is positioned within fulcrum 30 during use.

With reference now to FIG. 10, fulcrum 30 comprises outer tube 134, bushings 136, 138, end cap 139, bottom fulcrum plate 142, and top cover 144. Outer tube 134 is mounted on inner pin 132 with the bushings placed therebetween. Outer tube 134 is selectively rotatable about inner pin 132 and has plate 142 coupled thereto. Locking pin assembly 131 is adapted to allow a user to selectively lock the resilient elongate members 28 in a storage position or in a use position by selectively locking outer tube 134 with respect to inner pin 132. Locking pin assembly 131 maintains fulcrum 30 in a fixed position on frame 14. In one embodiment, locking pin assembly 131 allows the user to select the amount of force used to secure the fulcrum 30 to frame 14.

Inner pin 132 is coupled to baseplate 40, which is coupled to post 14 of frame 12. Inner pin 132 provides a support around which outer tube 134 rotates. Inner pin 132 includes a plurality bores 133 (e.g., three bores) spaced radially about inner pin 132. The bores may be placed on the sides and bottom of pin 132, for example, such that the elongate members selectively achieve (i) a substantially horizontal position when moved above pin 132 or substantially vertical positions when moved to either side of pin 132.

Bores 133 are adapted to receive the distal end of a pin 131*a* of locking pin assembly 131, which can extend partially through outer tube 134 and into a bore 133. This allows the user to lock fulcrum 30 in the storage position or the use position. As indicated above, outer tube 134 is adapted to rotate around inner pin 132. Bushings 136 and 138 are positioned between inner pin 132 and outer tube 134 to reduce the friction between inner pin 132 and outer tube 134 during rotation of outer tube 134. End cap 139 is positioned at the end of outer tube 134 distal to baseplate 40. End cap 139 is adapted to cover the aperture formed by outer tube 134.

In the embodiment shown, bottom fulcrum plate 142 of fulcrum 30 is coupled to outer tube 134. A plurality of pins (e.g., six pins or any number corresponding to the number of elongate members) extend upwardly from bottom fulcrum plate 142. The pins extending from plate 142 are adapted to be positioned in slots (not shown) formed on the underside surface of respective intermediate portions of resilient elongate members. In one embodiment, the configuration of slots in the elongate members and respective pins which fit therein allow for limited lateral movement of resilient elongate members, although the slots may be configured not to allow such lateral movement. The pins of plate 142 which fit into the slots in respective members 28 retain the intermediate portions of members 28 within fulcrum 30 even when the members 28 are moved to a storage position. Thus the members 28 do not slide out of the fulcrum 30.

Top plate 144 of fulcrum 30 is configured to be positioned over the plurality of resilient elongate members 28 and coupled to bottom plate 142 with the elongate members extending through respective slots in the top plate. Thus, resilient elongate members 28 are positioned between bottom fulcrum plate 142 and top cover 144 shown in FIG. 10 in a clamshell configuration. Bottom plate 142 may be angled downwardly on the sides thereof to accommodate the downward movement of the opposing sides of the elongate members.

In another embodiment, the elongate members are positioned within slots in the fulcrum and are allowed to freely slide within the slots or have rings or pins on opposing sides of the elongate members near the fulcrum that prevent them from sliding off the fulcrum.

In the embodiment of FIG. 10, locking pin assembly 131 includes a locking pin 131*a* coupled at its proximal end to a locking pin handle 131*b*. The locking pin 131*a* is slidably and/or rotatably coupled within a hollow body 131*c*. Hollow body 131*c* is threadedly coupled to the wall (e.g., the underside wall) of outer tube 134. This allows the distal end of the locking pin 131*a* to be inserted into a desired bore 133 in inner pin 132 in order to lock outer tube 134 with respect to inner pin 132. Locking pin 131*a* may be spring loaded and/or threaded at the distal end thereof such that pin 131*a* may be conveniently, selectively, removably coupled within a desired bore 133 and conveniently maintain outer tube 134 in a desired position with respect to inner pin 132.

To change the position of resilient elongate members 28, a user uncouples locking pin 131*a* away from inner pin 132, e.g., by unthreading pin 131*a* from a desired bore 133 (and/or pulling a springloaded pin out of the bore), then rotates outer tube 134. Once the user rotates the outer tube 134 to a desired position, the user can then couple pin 131*a* into another bore 133, such as by threading the distal end of pin 131*a* into bore 133 (and/or allowing a spring loaded pin to slide into the bore). Thus, in one embodiment, locking pin 131*a* is spring loaded and distal threads on locking pin 131*a* can be threaded into a bore 133 in order to affix fulcrum 30 into a tightly locked position. In yet another embodiment, a locking pin of the present invention is merely a threaded or non-threaded pin.

Fulcrum 30 of FIG. 10, however, is merely one embodiment of a fulcrum of the present invention. A fulcrum of the present invention may comprise a variety of different objects or surfaces which an elongate member or members contact as one or more ends of the elongate members is flexed. For example, a pin, rod, plate, beam, member, post, assembly, mechanism, or any surface thereof may act as a fulcrum. For instance, a surface of a post (e.g., the top surface of a post or other portion of a post on which a member or members may be mounted) may serve as an integral fulcrum on which an elongate member or plurality of members may be positioned as the end or ends thereof are flexed. As another example, a pin or beam extending from a frame is another example of a fulcrum upon which an elongate member can be positioned.

As a major advantage to the exercise device of the present invention, a variety of different exercises may be performed on the exercise devices of the present invention, such as leg curls, biceps curls, reverse flys, chest press, triceps pressdowns, ab crunches, leg presses, leg extensions, lat pull downs, butterflys, and a variety of other exercises.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise machine, comprising:

a support assembly;

at least one resilient elongate member having a first end, a second end, and an intermediate portion, wherein the intermediate portion is positioned on the support assembly and the first and second ends of the at least one resilient elongate member extend away from the support assembly; and a cable and pulley system coupled to the support assembly and the at least one resilient elongate member, the cable and pulley system having at least one cable adapted to be moved by the user, wherein the exercise machine comprises a plurality of elongate members and wherein the amount of resistance provided by each resilient elongate member corresponds with the diameter of the resilient elongate member.

2. The exercise machine of claim 1, wherein the support assembly comprises a fulcrum, the intermediate portion of the elongate member being positioned thereon.

3. The exercise machine of claim 2, wherein the fulcrum is movably coupled to a frame such that the resilient elongate member is selectively movable between a storage position and a use position.

4. The exercise machine of claim 2, wherein the fulcrum is non-integrally coupled to a frame.

5. The exercise machine of claim 2, wherein the fulcrum is integrally coupled to a frame.

6. The exercise machine of claim 1, wherein the at least one resilient elongate member provides resistance to movement of a cable of the cable and pulley system.

7. An exercise machine, comprising:

a support assembly;

at least one resilient elongate member having a first end, a second end, and an intermediate portion, wherein the intermediate portion is positioned on the support assembly; and a cable and pulley system coupled to the support assembly and the at least one resilient elongate member, the cable and pulley system having at least one cable adapted to be moved by the user; and further comprising at least one capture device, the at least one capture device including a substantially horizontally oriented capture member that extends from a main body and is configured to releasably capture at least one resilient elongate member.

8. The exercise machine of claim 7, wherein the at least one capture device is coupled to a first resilient elongate member, and wherein the capture device is configured to capture a second resilient elongate member.

9. The exercise machine of claim 7, wherein the at least one capture device further comprises a second capture member that extends from the main body and is configured to capture at least one resilient elongate member.

10. The exercise machine of claim 9, wherein the second resilient elongate member can be captured with the at least one capture device using one hand.

11. The exercise machine of claim 7, wherein the at least one capture device is configured to be coupled to at least one pulley.

12. The exercise machine of claim 11, wherein the second resilient elongate member is captured by positioning the second resilient elongate member under the at least one capture device and then releasing the second resilient elongate member.

13. An exorcise machine as recited in claim 1, wherein the at least one resilient elongate member and the cable and pulley system are configured such that movement of a first end of the at least one cable causes movement of both ends or the at least one resilient elongate member and such that movement of a second end of the at least one cable causes movement of both ends of the at least one resilient elongate member.

14. The exercise machine of claim 13 wherein movement of both the first and second end of the at least one cable causes movement of both ends of the least one resilient elongate member.

15. The exercise machine of claim 13, wherein the cable and pulley system is selectively coupled to the support assembly and/or the at least one resilient elongate member.

16. An exercise machine as recited in claim 13, wherein the cable and pulley system comprises a first pulley and a second pulley, the first pulley being coupled to the first end of the at least one resilient elongate member, and the second pulley being coupled to the second end of the at least one resilient elongate member.

17. A machine as recited in claim 16, wherein the at least one cable has a first end, a second end, and an intermediate portion, the intermediate portion being movably coupled to the first and second pulleys.

18. An exercise machine as claim 1, wherein resistance to movement experienced at a first end of the at least one cable is equal to the resistance to movement experienced at a second end of the at least one cable, and wherein the resistance experienced at each end of the at least one cable when force is simultaneously exerted at both ends of the at least one cable is greater than the resistance experienced at the first end of the at least one cable when force is exerted at the first end alone.

19. An exercise machine as recited in claim 18, wherein:

the movement of the first end of the at least one resilient elongate member is in inverse proportion to its resistive force;

the movement of the second end of the at least one resilient elongate member is in inverse proportion to its resistive force; and the ratio of movement of the first end of the at least one resilient elongate, member to movement of the second end of the at least one resilient elongate member is in inverse proportion to the radio of the resistive force of the first end of the at least one resilient elongate member to the resistive force of the second end of the at least one resilient elongate member.

20. The exercise machine of claim 19, wherein the resistive force of the first end of the at least one resilient elongate member is equal to the resistive force of the second end of the at least one resilient elongate member.

21. An exercise machine as recited in claim 1, wherein the at least one cable has first and second ends and wherein the total resistance experienced when force is simultaneously exerted at both ends of the at least one cable is greater than the resistance experienced at the first end of the at least one cable when force is exerted at the first end of the at least one cable alone.

22. An exercise machine as recited in claim 21, wherein the total resistance experienced when force is simultaneously exerted at both ends of the at least one cable is approximately twice the resistance experienced at the first end of the cable when force is exerted at the first end alone.

23. An exercise machine comprising:

a support assembly;

at least one resilient elongate member positioned on the support assembly, the at least one resilient elongate member having a first end, a second end, and an intermediate portion;

a cable and pulley system coupled to the support assembly and the at least one resilient elongate member, the cable and pulley system having at least one cable adapted to be moved by the user against the resistance of the at least one resilient elongate member, the cable having first and second ends;

wherein movement of the at least one cable displaces the first and second ends of the at least one resilient elongate member, flexing the at least one resilient elongate member, and wherein the amount of displacement of the cable first end is greater than the total amount of displacement of the first end and the second end of the at least one resilient elongate member when the user moves the cable first end to displace the first end and second end of the at least one resilient elongate member and wherein the total amount of displacement of the cable first end and second end is greater than the total amount of displacement of the first end and second end of the resilient elongate member when the user moves the cable first end and second end to displace the first end and second end of the at least one resilient elongate member.

24. An exercise machine as recited in claim 23, wherein the cable and pulley system comprises first and second pulleys, the first pulley being coupled to the first end of the at least one resilient elongate member, and the second pulley being coupled to the second end of the at least one resilient elongate member.

25. A machine as recited in claim 24, wherein the intermediate portion of the cable is movably coupled to the first pulley and the second pulley.

26. A machine as recited in claim 23, wherein the total amount of displacement of the cable first end and second end is approximately double the total amount of displacement of the first end and second end of the resilient elongate member when the user moves the cable first end and second end to displace the first end and second end of the at least one resilient elongate member.

27. An exercise machine, comprising:

a frame;

a resistance assembly having a plurality of substantially horizontal resilient elongate members, the resistance assembly having (i) opposing first and seconds ends; and (ii) an intermediate portion, the resistance assembly coupled to the frame such that the first and second ends extend away from the intermediate portion of the resistance assembly; and a cable and pulley system coupled to the frame and the resistance assembly, the cable and pulley system having at least one cable adapted to be moved by the user against the resistance of the resistance assembly, wherein the intermediate portion of the resistance assembly has a plurality of elongate portions extending from one end thereof and a plurality of don gate portions extending away from an opposing end thereof, the intermediate portion being coupled to the frame.

28. A machine as recited in claim 27, wherein the resistance assembly comprises a fulcrum and a plurality of resilient elongate members positioned on the fulcrum.

29. A machine as recited in claim 27, wherein the cable and pulley system comprises first and second pulleys, the first pulley being coupled to the first end of the resistance assembly, and the second pulley being coupled to the second end of the resistance assembly.

30. A machine as recited in claim 29, wherein the cable of the cable and pulley system has a first end, a second end, and an intermediate portion, the intermediate portion being movably coupled to the first and second pulleys.

31. An exercise machine that utilizes resilient elongate members to provide resistance for the user to exercise against, comprising:

a support assembly having a fulcrum;

first and second resilient elongate members, each of the resilient elongate members having a first end, a second end, and intermediate portion, wherein the first, and second resilient elongate members are positioned on the fulcrum;

a cable and pulley system coupled to the support assembly and the resilient elongate members, the cable and pulley system having at least one cable adapted to be moved by the user against the resistance of the resilient elongate members; and at least one capture device coupled to the first resilient elongate member, the capture device having at least one substantially horizontally oriented capture member, the capture member being configured to releasably capture the second resilient elongate member.

32. An exercise machine recited in claim 31, wherein the capture device comprises a main body mid a substantially horizontally oriented capture member extending therefrom, the main body being coupled to the first resilient elongate member, the capture member extending in a substantially horizontal direction from the main body.

33. An exercise machine recited in claim 31, wherein the second resilient elongate member can ho captured with the at least capture device using one hand.

34. An exercise machine recited in claim 33, wherein the second resilient elongate member can be captured by pressing the second resilient elongate member under the at least one capture device and then releasing the second resilient elongate member.

35. A foldable exercise machine that can be conveniently stored, the exercise machine comprising:

a frame;

a fulcrum coupled to the frame;

at least one resilient elongate member positioned on the fulcrum, the elongate member having (i) a first end, (ii) a second end, and (iii) an intermediate portion, wherein the at least one resilient elongate member is rotatable with respect to the frame; and a cable and pulley system coupled to the flame and the at least one resilient elongate member, the cable and pulley system having at least one cable adapted to be moved by the user against the resistance of the at least one resilient elongate member.

36. The exercise machine of claim 35, wherein the at least one resilient elongate member is rotatable between a first position and a second position.

37. The exercise machine of claim 36, wherein the first position comprises a substantially horizontally oriented use position while the second position comprises a substantially vertically oriented storage position.

38. An exercise machine that can be conveniently stored, comprising:

a support assembly having a fulcrum; and at least one flexible, resilient elongate member adapted to provide resistance, the elongate member having a first end, a second end, and an intermediate portion, wherein the resilient elongate member is positioned on the support assembly and wherein the at least one resilient elongate member is movable such That the resilient elongate member can be moved from a use position to a storage position, and wherein the at least one resilient elongate member is rotatable into a storage position, wherein the fulcrum includes a movable apparatus, and wherein the movable apparatus of the fulcrum is rotatable such that rotation of the movable apparatus rotates the plurality of resilient elongate members into a storage position; and a cable and pulley system coupled to the support assembly and the at least one flexible, resilient elongate member, the cable and pulley system having at least one cable adapted to be moved by a user against the resistance of the at least one resilient elongate member.

39. The exercise machine of claim 38, further comprising a bench.

40. The exercise machine of claim 39, wherein the bench is movable into a storage position.

41. The exercise machine of claim 39, wherein the bench is foldable into a storage position.

42. An exercise machine comprising:

a support assembly;

at least one resilient elongate member coupled to the support assembly, the at least one resilient elongate member adapted to provide a resistance for exercise;

a cable and pulley system adapted to convey resistance provided by the resilient elongate members, wherein one or more cables of the cable and pulley system are adapted to be coupled to a first and second point of resistance provided by the one or more resilient elongate members; and first and second grip members adapted to permit a user to utilize the resistance conveyed by the cable and pulley system, wherein an equal amount of resistance is provided at the first and second grip members when an unequal amount of resistance is provided at the first and second point of resistance, wherein the at least one resilient elongate member comprises a plurality of resilient elongate member, the plurality of resilient elongate members having a first end and a second end and wherein the first point of resistance corresponds with the first end of the plurality of resilient elongate members and the second point of resistance corresponds with the second end of the plurality of resilient elongate members.

43. The exercise machine of claim 42, wherein an equal amount of resistance is provided at the first and second grip members when an equal, or unequal, amount resistance is provided at the first and second point of resistance provided by the resilient elongate members.

44. The exercise machine of claim 42, wherein the at least one resilient elongate member has a first end, a second end, and an intermediate portion, the intermediate portion configured to be in contact with a fulcrum of the exercise machine.

45. The excercise machine of claim 42, wherein the amount of resistance provided by the plurality of resilient elongate members is variable due to the number and configuration of the resilient elongate members coupled to the cable and pulley system.

46. The exercise machine of claim 45, wherein the one or more cables of the cable and pulley system comprises a single cable having a first end adapted to be selectively coupled to the first end of the plurality of resilient elongate members and a second end adapted to be selectively coupled to the second end of the plurality of resilient clongate members.

47. The excercise machine of claim 46, wherein an equal amount of resistance is provided at the first and second grip members when an unequal number of resilient elongate members are coupled the first and second ends of the cable and pulley system.

48. The excercise machine of claim 47, wherein the at least one resilient elongate member comprises a plurality of resilient elongate members having a single end adapted to be directly of indirectly coupled to the cable and pulley system.

49. A machine as recited in claim 35, wherein the frame comprises an upstanding post and a base member coupled to the post.

50. A machine as recited in claim 45, wherein the intermediate portion of the elongate member is positioned on the fulcrum, which is coupled to the post.

* * * * *

UNITED STATES PATENT AND TRADEMARK OFFICE

CERTIFICATE OF CORRECTION

PATENT NO. : 7,250,022 B2
APPLICATION NO. : 10/173515
DATED : July 31, 2007
INVENTOR(S) : Dalebout et al.

It is certified that error appears in the above-identified patent and that said Letters Patent is hereby corrected as shown below:

Title Page
Item 57, Abstract, Line 8, change “use” to --user--

Title Page 2
Foreign Patent GB 5867, change “0/1913” to --7/1913--
Third ‘Other Publication’, change “printied” to --printed--

Column 6
Line 16, after “34” insert --and 32--
Line 43, change “14” to --40--

Column 11
Line 3, change “28” to --26--

Column 14
Line 1, change “exorcise” to --exercise--
Line 13, change “13” to --1--
Line 16, change “13” to --1--
Line 26, after “as” insert --recited in--
Line 44, after “elongate” remove --,--
Line 44, after “member to” insert --the--
Line 46, change “radio” to --ratio--

Column 15
Line 60, replace “don gate” with --elongate--

Column 16
Line 28, change “mid” to --and--
Line 34, change “ho” to --be--
Line 50, change “flame” to --frame--

Column 17
Line 3, change “That” to --that--

UNITED STATES PATENT AND TRADEMARK OFFICE

CERTIFICATE OF CORRECTION

PATENT NO. : 7,250,022 B2
APPLICATION NO. : 10/173515
DATED : July 31, 2007
INVENTOR(S) : Dalebout et al.

It is certified that error appears in the above-identified patent and that said Letters Patent is hereby corrected as shown below:

Column 18
Line 25, change "clongate" to --elongate--
Line 35, change "of" to --or--
Line 39, change "45" to --49--

Signed and Sealed this

Thirteenth Day of May, 2008

JON W. DUDAS
*Director of the United States Patent and Trademark Office*